United States Patent [19]

Otoshi

[11] 4,287,727

[45] Sep. 8, 1981

[54] FLAT BED KNITTING MACHINE

[75] Inventor: Kazuo Otoshi, Hiroshima, Japan

[73] Assignee: Tatsumi Seiki Co., Ltd., Hiroshima, Japan

[21] Appl. No.: 120,955

[22] Filed: Feb. 12, 1980

[30] Foreign Application Priority Data

Jun. 18, 1979 [JP] Japan ..... 54-84074[U]

[51] Int. Cl.[3] ..... D04B 7/00; D04B 15/66

[52] U.S. Cl. ..... 66/75.2; 66/78

[58] Field of Search ..... 66/75.2, 73 R, 75.1, 66/64, 78, 225

[56] References Cited

U.S. PATENT DOCUMENTS

| | | | |
|---|---|---|---|
| 3,304,748 | 2/1967 | Seiler | 66/64 |
| 3,605,450 | 9/1971 | Goller et al. | 66/78 |
| 3,615,145 | 10/1971 | Goller et al. | 66/78 |
| 3,693,377 | 9/1972 | Hadam | 66/78 X |
| 3,892,108 | 7/1975 | Hadam | 66/75.2 |
| 3,913,354 | 10/1975 | Kohler et al. | 66/75.2 |
| 3,955,381 | 5/1976 | Panchaud | 66/75 |
| 4,100,767 | 7/1978 | Schieber | 66/75.2 |
| 4,196,599 | 4/1980 | Guell | 66/75.2 |
| 4,197,722 | 4/1980 | Cote-Petit et al. | 66/75.2 |

*Primary Examiner*—Ronald Feldbaum
*Attorney, Agent, or Firm*—Blanchard, Flynn, Thiel, Boutell & Tanis

[57] ABSTRACT

A flat bed knitting machine comprising a jack disposed in needle slot for controlling the movement of the needle, and selector jack for actuating the jack. The selector jack is tiltable upon being pushed by a selector controllable electrically in accordance with a pattern for lowering its butt out of the camming action. A group of cams for acting on the jack butts comprises tuck cams for advancing needles to a tucking position, and a unit of movable and fixed cams arranged in an inverted V-shape around the tuck cams for advancing needles to a knitting position. A combination of knitting, tucking and non-knitting in one course can be performed by jacks selectable in a preceding step so as to be shifted to a tuck cam acting position, and movable under the movable cams being retracted in a following step so as to engage the tuck cams, by jacks newly selectable so as to engage the cams which advance needles outside of the tuck cams to the knitting position, and by jacks that can be maintained at rest.

8 Claims, 9 Drawing Figures

FLAT BED KNITTING MACHINE

BACKGROUND OF THE INVENTION

1. Field of the Invention

The present invention relates to a flat bed knitting machine of the type having, in needle slots in needle beds, knitting needles jacks for controlling the movement of the needles, and selector jacks for actuating the needle-actuating jacks, there being selectors electrically operable or controllable for selecting selector jacks, so that a combination of knitting, tucking, and non-knitting can be performed in one course.

2. Prior Art

Knitting machines are well known in which electrically operated or controlled selectors push and tilt selected selector jacks for retracting their butts out of the camming action. With such type of knitting machine, however, only a combination of two out of knitting, tucking and non-knitting is possible to be effected in one course. Several flat bed knitting machines are known in which a combination of knitting, tucking and non-knitting can be performed in one course.

One of such knitting machines is a Jacquard flat knitting machine disclosed in U.S. Pat. No. 3,304,748. With this knitting machine, however, needle selection is carried out mechanically, but not electrically, as is well known.

Another such knitting machine is disclosed in U.S. Pat. No. 3,955,381. The disclosed flat bed knitting machine has in each needle slot in a needle bed a knitting needle, a jack for controlling movement of the knitting needle, a selector jack for operating a needle-actuating jack, and a selector movable in accordance with a pattern, the selector jack being available in a variety of shapes with convexities or projections located in varying positons on stems. By engaging the selector with the convexity and pushing the same, the selector jack is caused to flex in the needle slot, enabling the butt thereon to be positioned out of camming action. With such an arrangement, while several kinds of selector jacks are selectively positionable in accordance with a pattern, those selector jacks having convexities located in the same position are only allowed at all times to locate the needles associated therewith in either knitting, tucking or non-knitting position. In other words, such needles are not positionally selectable between two or more different positions. Accordingly, the selector jack must be changed in position each time a different pattern is to be used. Another problem is that the selector jack is subject to repeated flexing through a number of needle selections and hence tends to be broken soon. One solution would be to use a long jack which is free of early breakage; however, it would result in an enlarged needle bed.

Still another type of flat bed knitting machine shown in U.S. Pat. No. 3,693,377 has selectors that are electrically operable or controllable in accordance with a pattern.

With such knitting machine, selector jacks are advanced on the cam formed on a selector, and the selector for advancing the selector jacks must be held in engagement with the convexity on a stem of the selector jack at least during the advancing movement. As the carriage travels faster, therefore, the selector tends to engage the convexity of a next selector jack before the selector is returned completely. For enabling the selector to engage the convexity of a desired selector jack only in order to select needles correctly, it is necessary to move the carriage at a lower speed, or to have a longer distance between adjacent convexities positioned in the same location. A variety of kinds of selector jacks having differently positioned convexities, and a multiplicity of selectors and a selector actuator would be required for that purpose, resulting in a complicated knitting machine. Furthermore, the jacks are bent so as to allow the butt to be retracted out of the camming action, so that the jacks are also liable to be broken with this type of flat bed knitting machine.

SUMMARY OF THE INVENTION

According to the present invention, a needle bed has a plurality of needle slots each receiving a knitting needle, a jack for controlling the movement of the needle, and a selector jack tiltable in the slot for remaining at rest the needle-actuating jack. A selector that is electrically actuatable or controllable momentarily pushes a convexity on a stem of the selector jack to tilt the same, so that the butt on the selector jack is moved away from a cam for advancing or lowering the butt. The selector jacks that are not pushed by the selectors raise jacks associated therewith. The raised jacks can advance the associated needles to a tucking position in a step for knitting a following course. The jacks which are newly selected in the latter step for being raised to advance the needles to a knitting position, and the jacks which are associated with the selector jacks that are retracted upon being twice selected, for resting the needles to a non-knitting position, can be combined in operation in one step. Accordingly, a combination of knitting, tucking and non-knitting can be performed in one course.

It is an object of the present invention to provide cam means for combining jacks selected in a preceding step with other jacks in a following step.

It is another object of the present invention to provide a flat bed knitting machine in which the arrangement of selector jacks is not required to change each time a different pattern is used.

Another object of the present invention is to provide a flat bed knitting machine that can be operated at high speeds.

Still another object of the present invention is to provide a simple needle selection mechanism.

These and other objects and advantages of the present invention will become apparent from the detailed description when taken in conjunction with the accompanying drawings which illustrate certain preferred embodiments by way of example.

DETAILED DESCRIPTION

Figure 1:
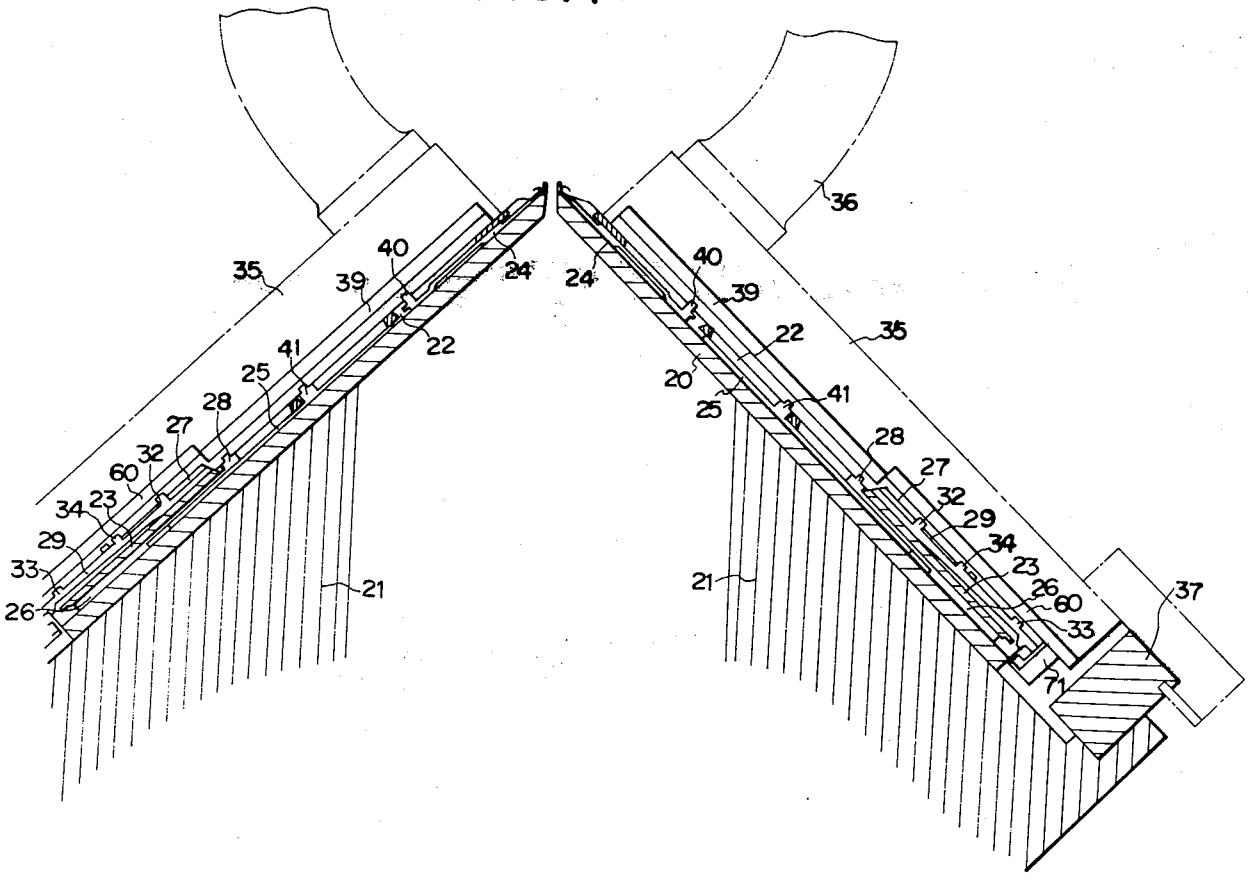
FIG. 1 is a fragmentary cross-sectional view of a flat bed knitting machine having needle beds and carriages with cam plates.
Figure 2:
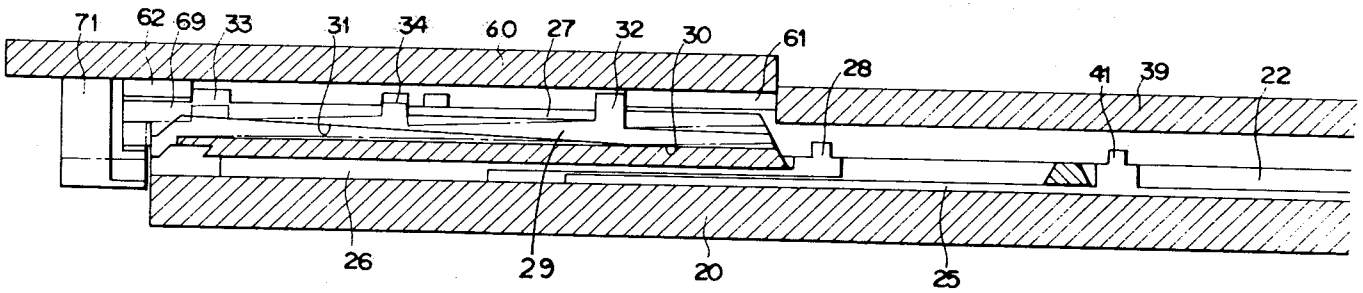
FIG. 2 is an enlarged cross-sectional view of a portion of the parts shown in FIG. 1.
Figure 4:
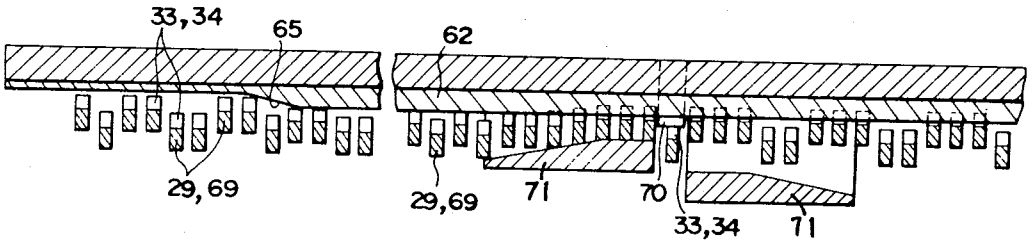
FIG. 4 is an enlarged fragmentary cross-sectional view taken along line I—I of FIG. 3.

In FIG. 1, a pair of needle beds 20, 20 mounted on a frame 21 arranged in the cross-sectional shape of an inverted V as well known in the art, and each have a multiplicity of needle slots 22 in its one surface. The needle slots 22 are closed off by an auxiliary needle bed 23 to define channels at their lower portions. In each needle slot 22, there are disposed a knitting needle 24, a main jack 25 engaging the rear end of the knitting needle 24 for upward advancing movement thereof, and an auxiliary jack 26 inserted in the channel and engaging the rear end of the main jack 25 for upward advancing movement thereof. A selector jack 29 is disposed in a slot 27 above the auxiliary needle bed 23 and is held in contact with a butt 28 of the auxiliary jack 26 for advancing the latter upwardly. The selector jack 29 has its bottom defined by a flat upper surface 30 and a tapered lower surface 31 in the rearward direction, as illustrated in FIG. 2. When the selector jack 29 is pushed down, it is lowered through angular movement until the tapered surface 31 abuts against the bottom of the needle slot 27. The selector jack 29 includes a butt 32 for acting on a selector jack lowering cam and a butt 33 for acting on a selector jack lifting cam, the butts 32, 33 being located at upper and lower positions on a stem of the selector jack. A convexity or projection 34 is positioned between the butts 32, 33, and is laterally displaced from a convexity or projection on an adjacent selector jack. In the illustrated embodiment, adjacent projections 34 are laterally staggered with respect to one another.

A pair of carriages 35, 35 with cam plate assemblies are mounted on the needle beds 20, 20, respectively, and are interconnected by a bridge 36. Each of the carriages 35 is supported and guided by a rail 37 secured to the frame 21.

Figure 3:
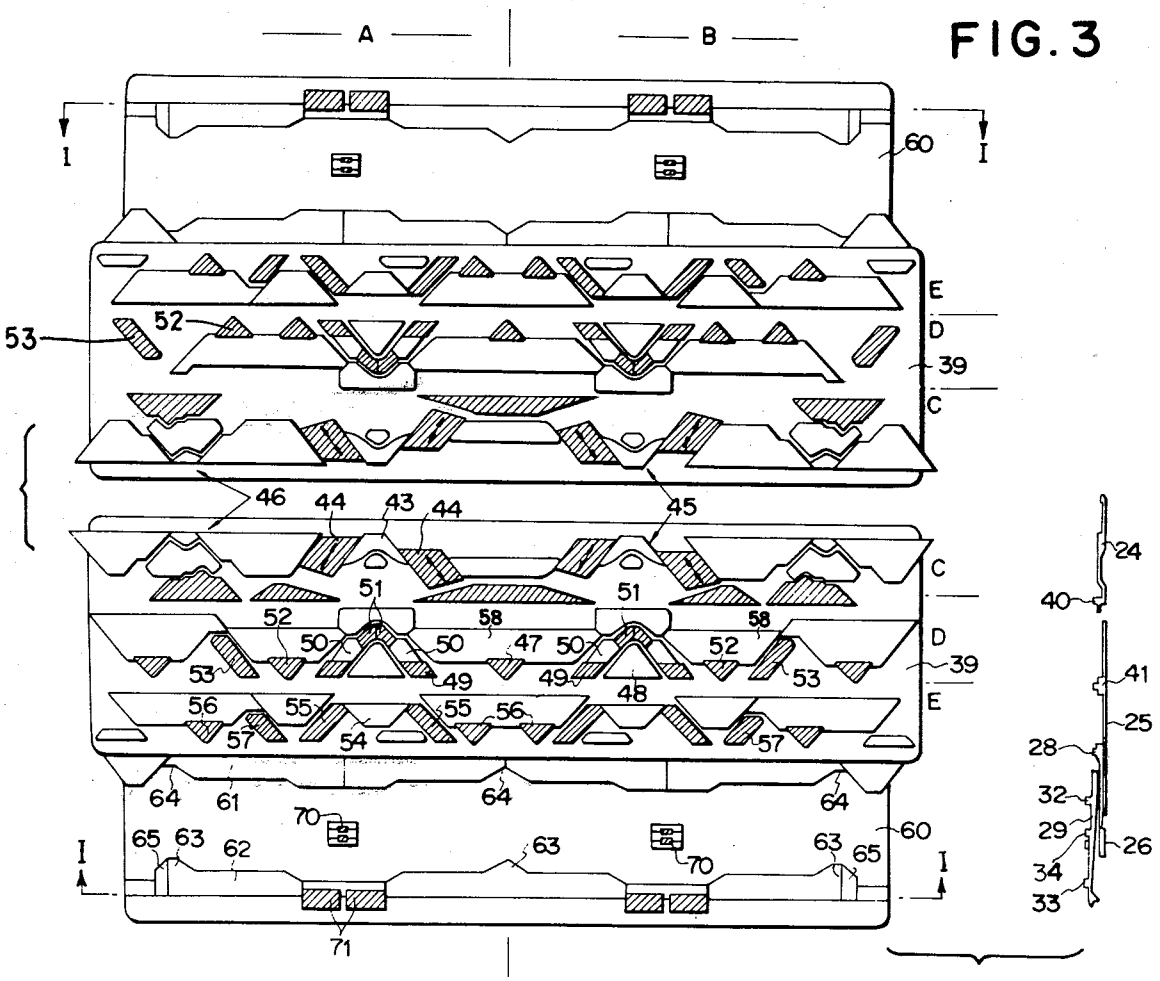
FIG. 3 is a bottom plan view of a pair of opposite cam plates having various cams that can act on needle butts, main jack butts, and selector jack butts.

As illustrated in FIG. 3, the cam plate assembly is comprised of an upper cam plate 39 and a lower cam plate 60, acting as a cam system of double construction. Designated at A and B are cam systems that are substantially identical in structure to each other and are arranged in the longitudinal direction of the cam plates.

The cams on the upper cam plate 39 are divided into a group called zone C for acting on the butts 40 of the needles 24, a group called zone D for acting on the butts 41 on the main jacks 25, and a group called zone E for acting on the butts 28 of the auxiliary jacks 26. Those cams which are shown hatched in FIG. 3 are movable forwardly and rearwardly on or along the cam plates.

The zone C in each system A, B comprises knitting cam group 45 including safety cam 43 and stitch cams 44 disposed on opposite sides of the safety cam 43, and transferring cam group 46. The zone D comprises a central lowering cam 47, and in each system A, B, a tuck cam 48, lower knitting cams 49, lifting cams 50, upper knitting cams 51, the latter three being arranged substantially in the form of an inverted V around the tuck cam 48, a pair of lowering cams 52, and a transferring cam 53 at an end portion of the cam plate, and fixed subsidiary cams 58 disposed upwardly of the lowering cams 47, 52 for lowering the jacks 25. The transferring cam 53 is located between the lowering cams 52 on one of the cam plates 39 that is disposed forwardly, and the transferring cam 53 is located outwardly of the lowering cams 52 on the other cam plate 39 disposed rearwardly. The zone E includes in each system A, B a subsidiary cam 54, a pair of knitting cams 55 one on each side of the subsidiary cam 54, a pair of lowering cams 56 disposed one on each side of the knitting cams 55, and a lifting cam 57 positioned between the outer lowering cam 56 and the knitting cams 55.

On the lower cam plate 60, there are disposed upper cams 61 for acting from above the butts 32 of the selector jacks 29, and lower cams 62 for acting from below the butts 33 of the selector jacks 29. The upper and lower cams 61, 62 include lowering portions 64 and lifting portions 63, respectively, provided complemetarily in opposed relation at central and end areas of the cam plate for lowering and raising the selector jacks 29. The lifting cam portions 63 at the end areas have tapered surfaces 65 inclined with respect to the plane of the cam plate. At the start of travel of carriage, the selector jack butts 33 ride on the inclined surfaces 65 without engaging the lifting portions 63, only the central and rear lifting portions 63 with respect to the direction of travel of the carriage operating on the butts 33 of the selector jacks 29 with their rear portions lifted by movable arranging cams described later.

A plurality of selectors 70 (two in the illustrated embodiment) extend parallel to each other in the longitudinal direction of the cam plate 60 and are located between the lifting portions 63 and correspondingly to the convexities 34 of the selector jacks 29, the selectors 70 being projectable and retractable by solenoids having switches that can be turned on and off by a pulsed signal produced in accordance with a pattern, as disclosed in U.S. Pat. No. 3,693,377 granted to Wilhelm Hadam on Sept. 26, 1972. When the selector 70 projects from the lower cam plate 60 to push the convexity 34 of a selector jack 29, the selector jack 29 is angularly moved, thereby causing the butt 33 to be disengaged from the cam 62 (as shown by the dot-and-dash lines in FIG. 2) so as to be positioned out of the camming action by the cam 62. The selector jacks which have not been pushed remain subject to the camming action by the cam 62. Positioned downwardly of the selectors 70 are a pair of arranging cams 71 locatable away from or closely to the plane of the lower cam plate 60 for acting on the shank 69. The arranging cams 71 are disposed one on each side of the selectors 70, and are alternately movable toward and away from the lower cam plate each time the carriage makes a reverse motion. More specifically, arranging cam 71 which is ahead with respect to the direction of travel of the carriage is moved toward and held in a position adjacent to the lower cam plate, and the other arranging cam which is behind is moved away and held in a position away from the lower cam plate. As the carriage moves, the shanks of the selector jacks are all lifted by one of the arranging cams 71 which is positioned adjacent to the lower cam plate, so as to be subjected to the camming action by the cam group 62. Then, the selector jacks except the one having a rear portion pushed by the selector into the needle slot 27, are moved upwardly by the lifting cam 63.

OPERATION

When knitting, tucking, and non-knitting are to be effected simultaneously in one course, it is necessary to have the following preparatory action done in advance.

Figure 5:
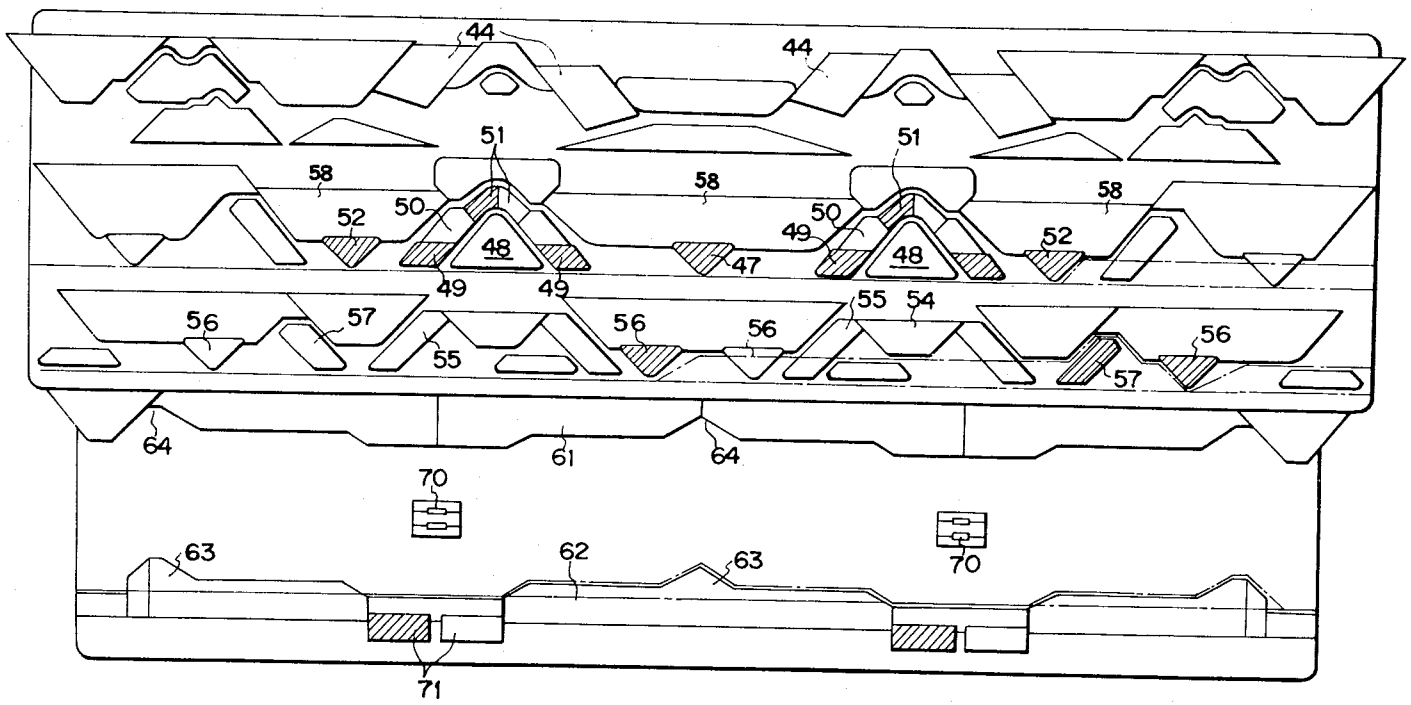
FIGS. 5 and 6 are bottom plan views of one of the cam plates, showing in phantom paths of travel of the needle butts, main jack butts, auxiliary jack butts, and selector jack butts with respect to the cams that are movable for various positional combinations.

In such preparatory action, the selector jacks associated with the needles for tucking in one of systems A, B are first picked out, and the selector jacks associated with the needles for knitting in the other system are then picked out. FIG. 5 is illustrative of such action, in which the hatched cams project from the cam plate for camming action. When the carriage is moved in the direction of the arrow, the selector jack butts 33 move past the lifting cam 63 in the system A, which is located upstream in the direction of travel of the carriage, and become aligned with each other in one plane by one of the arranging cams 71 which is adjacent to the lower cam plate so as to be in operative position. Then, a pulsed signal produced in accordance with a pattern turns on a switch to energize an associated solenoid, which then causes the selector 70 to project and push unnecessary selector jacks other than the selector jacks associated with needles for tucking. The pushed selector jacks have their rear portions depressed into the slots 27 so as to cause the butts 33 to be positioned out of the camming action by the cams 62. The selector jacks 29 that have not been pushed are held in the area subject to the camming action by the cams 62, moving on the middle lifting portion 63 to advance the auxiliary jacks 26 upwardly. The auxiliary jacks move over the lowering cam 56 and the knitting cams 55 that are retracted in the system B, and advance in engagement with the lifting cams 57. The main jacks 25 associated with the auxiliary jacks are pushed upwardly into a position subject to the camming action by the tuck cam 48, moving over a transferring cam 53 and a lowering cam 52 which are retracted. The auxiliary jacks 26 are then pushed downwardly by a next lowering cam 56 into a starting position.

The selector jack that has been advanced by the middle lifting portion 63 is immediately lowered by the lowering portion 64. Such selector jacks and the selector jacks pushed to a retracted position out of the camming action are again aligned by the arranging cam 71 in the system B. The selector jacks associated with needles for knitting in a following step are selected again by the selectors 70. The butts 33 of the selected selector jacks which are not pushed by the selectors again ride on the rear lifting portion 63 in the system B, pushing the auxiliary jacks 26 upwardly into a position subject to the camming action by the knitting cam 55. Preparation is thus completed. At this time, the selected main jacks are positioned in a location subject to the camming action by the tuck cam 48, and the auxiliary jacks selected separately from the auxiliary jacks which have raised the main jacks into the position subject to the camming action by the tuck cam are located in a position subject to the camming action by the knitting cams 55.

Figure 6:
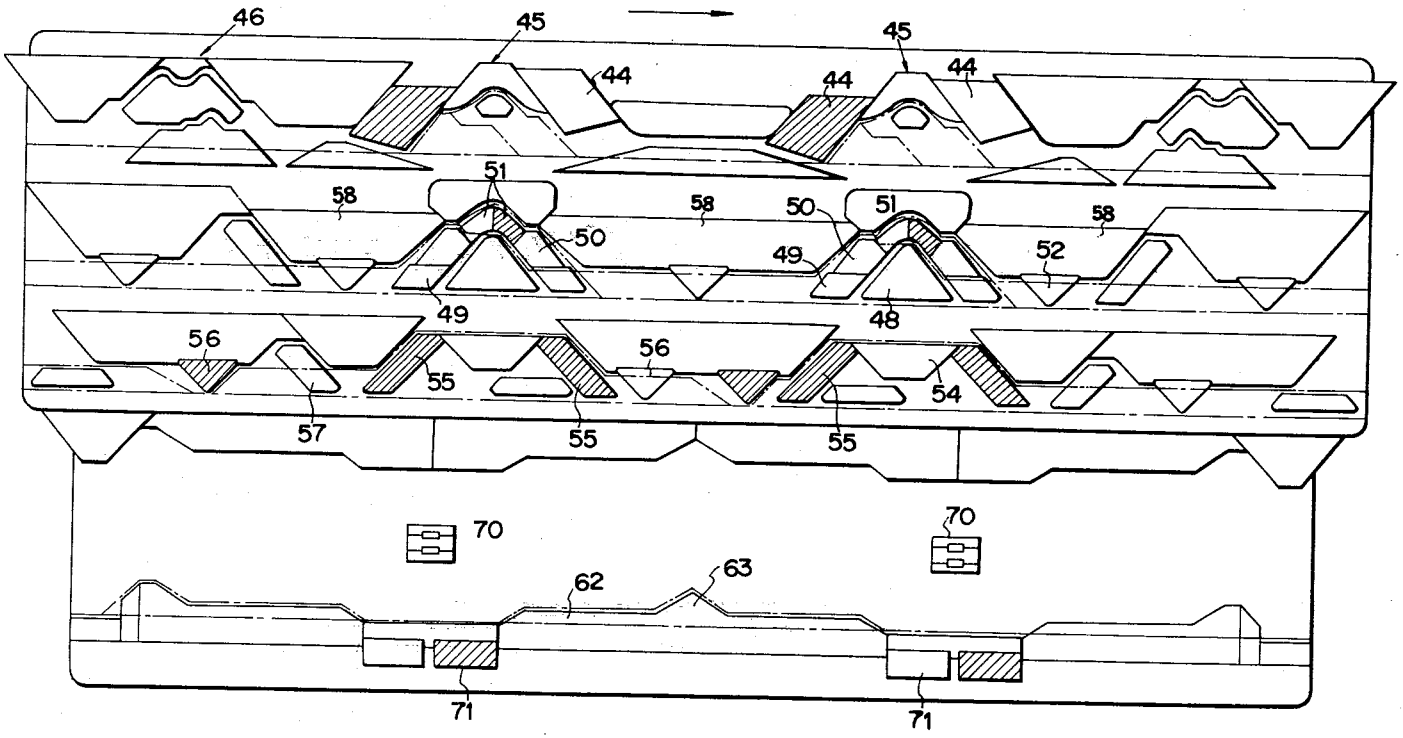

In FIG. 6, the knitting cams 49 in the zone D are in its retracting position, and in the zone E the knitting cams 55 and the lowering cam, which is located rear in the direction of travel of the carriage in each system A, B are in their projecting position. When the carriage makes a reverse movement upon arrival at an end of the needle bed, the auxiliary jack butts 28 that have been raised to the position subject to the camming action by the knitting cam 55 in the preceding step, move in the system B past the lowering cam 56 and lifting cam 57 that are retracted, and ride on the knitting cam 55, causing the butts 41 of the main jacks 25 with which the auxiliary jacks are associated to ride on the lifting cam 50 and the knitting cam 51 for thereby pushing the knitting needles 24 upwardly into a knitting position. The butts 41 of the main jacks 25 that have been raised to the position subject to the camming action by the tuck cam 48, move past the pair of lowering cams 52, transferring cam 53 and knitting cam 49, and ride on the tuck cam 48, pushing the knitting needles 24 upwardly into a tucking position. The knitting needles raised into the knitting and tucking positions are forced downwardly to an initial position by the lowering cam 44 after knitting operation. Simultaneously, the main jacks 25 and the auxiliary jacks 26 are lowered to a tucking position below the subsidiary cam 58 and an initial position below the lowering cam 56, respectively. The selector jacks retracted by the selector to the position subject to the camming action by the cam group 62 through two selections made respectively in systems A, B in the preceding steps, do not raise the auxiliary jacks 26 associated therewith. Therefore, the knitting needles 24 are held at rest in the needle bed for non-knitting. Knitting, tucking, and non-knitting are thus carried out in one course. The same operation is effected in the next system A, so that simultaneous knitting in two courses can be performed in one stroke.

Although a double cam system has been described above, a single cam system can be utilized for simultaneous knitting, tucking and non-knitting. With a single cam system, two preparatory steps are necessary. More specifically, the main jacks are moved to the tucking position by the selector jacks that select needles during advancing movement of the carriage, and the auxiliary jacks are moved to the knitting position by the selector jacks that select needles during returning movement of the carriage, or vice versa.

In FIG. 6, when the knitting cams 55 in zone E are retracted and auxiliary jack butts 28 move over the knitting cams 55, and hence tucking is effected only by the main jacks held in the tucking position without moving the associated main jacks upwardly. When the knitting cams 49 below the lifting cams 50 in zone D project to the position subject to the camming action, the main jacks disposed in the position subject to the camming action by the tuck cam, and the butts 41 of the main jacks raised by the auxiliary jacks 26 furnished butts 28 riding on the knitting cams 55, ride on the knitting cams 49, lifting cams 50 and knitting cams 51, whereupon the needles are shifted to a knitting position. In the above embodiment, the main jacks shifted to the tucking position may, prior to arrival at the knitting cam 49, partly or wholly be pushed upwardly to ride butts 41 on the knitting cams 51 by the auxiliary jacks provided butts riding on the knitting cam 55 to be selected later.

Figure 7:
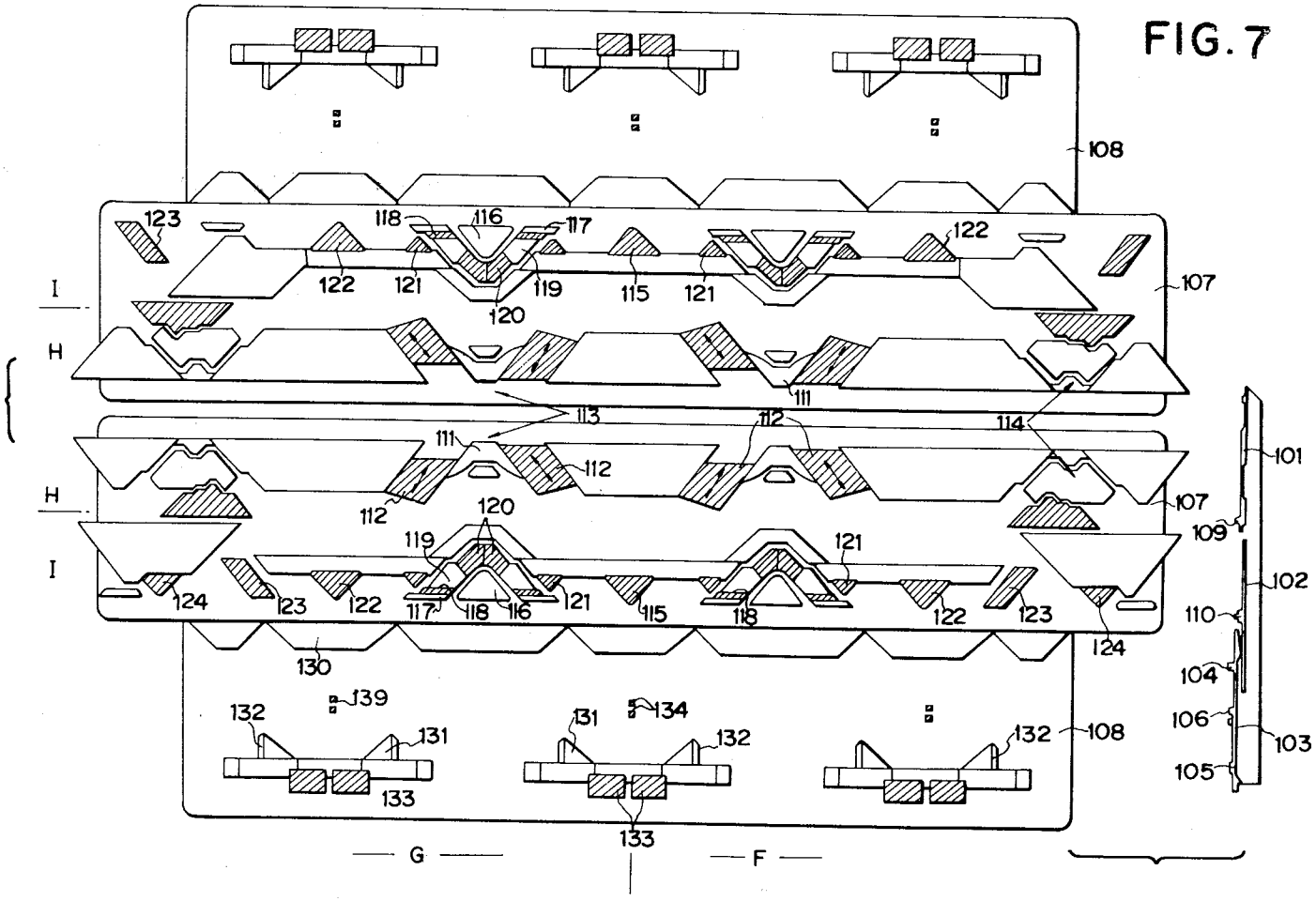
FIG. 7 is a bottom plan view of a pair of opposite cam plates according to another embodiment, having cams operable on needle butts, jack butts, and selector jack butts.
Figure 8:
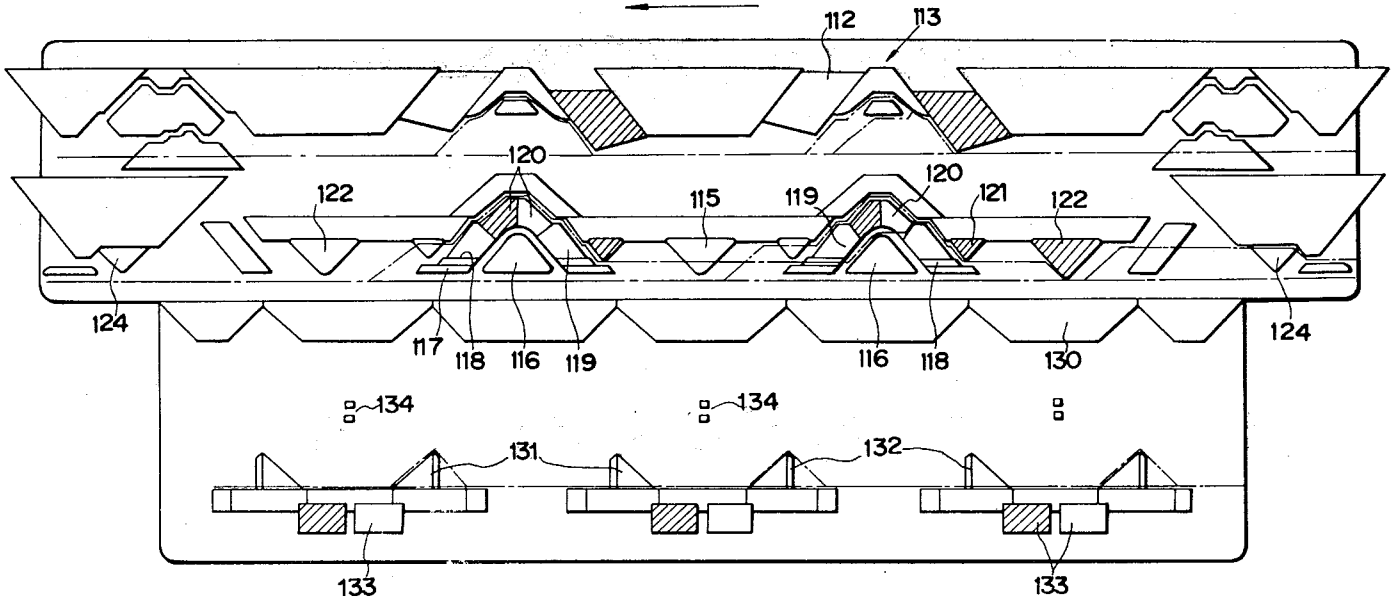
FIGS. 8 and 9 are bottom plan views of one of the cam plates of FIG. 7, each showing a parts position during knitting.
Figure 9:
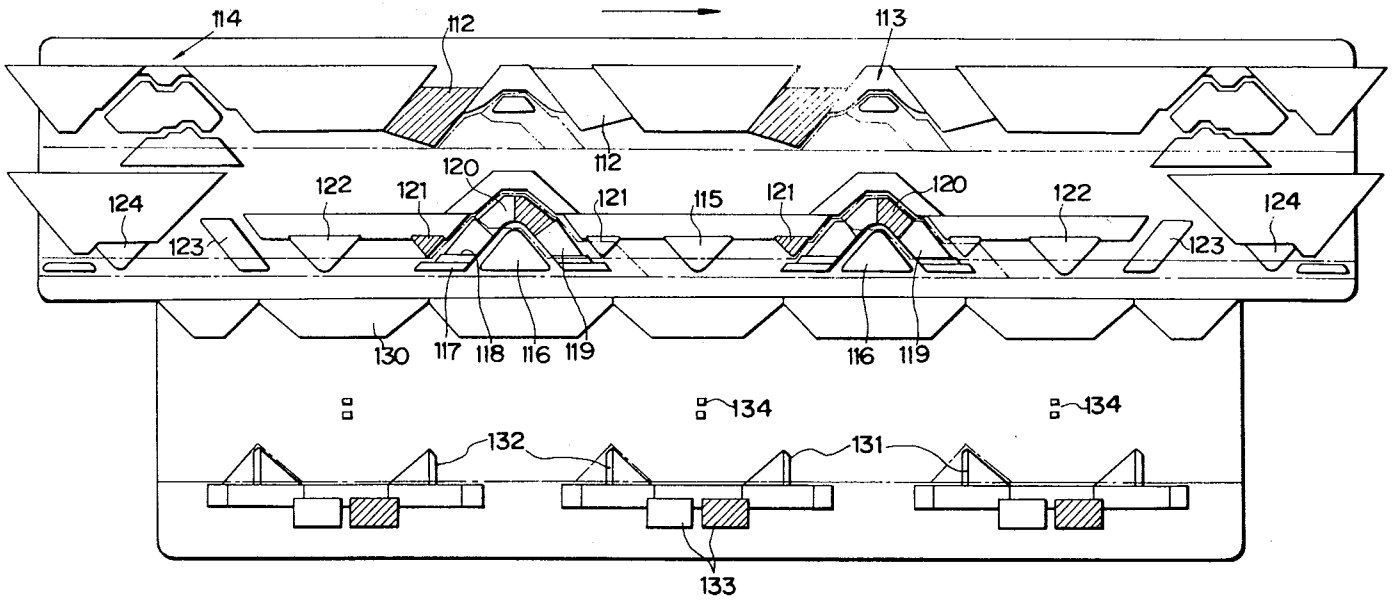

A needle bed shown in FIGS. 7 through 9 supports knitting needles 101 and jacks 102 both disposed longitudinally in needle slots, there being selector jacks 103 on an auxiliary needle bed. Each selector jack 103 is of substantially the same structure as the selector jack 28 described above, and has a bottom defined by a flat surface and a tapered surface. The rear portion, upon being pushed, is angularly movable downwardly. The selector jack 103 also includes a butt 104 and a butt 105 respectively on upper and lower portions of its stem, and a convexity or projection 106 disposed intermediate the butts 104, 105.

A cam plate assembly mounted on a carriage on the needle bed comprises an upper cam plate 107 and a lower cam plate 108, which support thereon substantially identical cam systems F and G that are arranged longitudinally of the cam plates and constitute a double cam system.

The upper cam plate 107 is divided into a zone H of cam groups for acting on the butts 109 of the needles 101, and a zone I of cam groups for acting on the butts 110 of the jacks 102. In FIG. 7, those cams which are shown hatched are movable forwardly and rearwardly on, or horizontally along the cam plates.

In each system F, G, the zone H comprises a knitting cam group 113 including a safety cam 111 and lowering cams 112 one on each side of the safety cam 111, and a transferring cam group 114. The zone I comprises a central lowering cam 115, and in each system F, G a tuck cam 116, fixed lifting cams 117, movable tuck selection cams 118, fixed medium lifting cams 119, movable knitting cams 120, the latter four being substantially in the form of an inverted V around the tuck cam 116, a pair of half lowering cams 121 disposed one on each side of the group of cams 116–120 for lowering the jacks 102 by an amount that is about half the amount the jacks 102 would be lowered by the lowering cam 115, a lowering cam 122 located outwardly of the half lowering cams 121 and in symmetrical relation to the lowering cam 115 with respect to the tuck cam 116, and a transferring cam 123 disposed outwardly of the lowering cam 122 at an end portion of the cam plate (a lowering cam 124 is additionally provided on the front cam plate at an end of the cam plate).

The lower cam plate 108 supports thereon an upper group of cams 130 for acting from above the butts 104 of the selector jacks 103 to lower the same, and a lower group of cams 131 for acting from below the butts 105 to raise the same. Each of the cams 131 has its one side tapered to form an inclined surface 132 on which butts 105 of the selector jacks 103 can ride for being moved onto the cam 131. A pair of arranging cams 133 having the same structure and function as that of the arranging cams 71 are disposed between each paired lifting cams 131 at a position therebeneath. A pair of selectors 134 are located intermediate the lifting cams 131 and the group of cams 130 and correspondingly in position to the convexities 106 of the selector jacks 103. The selector 134 can project from the lower cam plate 108 when a solenoid operatively connected thereto is energized by a pulsed signal produced in accordance with a pattern. On projection of the selector 134, the convexity 106 of one of the selector jacks 103 is pushed, angularly moving the selector jack to cause its rear portion to be inserted into the needle slot, whereupon the butt 105 is retracted out of the camming action by the cam 131, in the same manner as described above with reference to the preceding embodiment.

OPERATION

When the carriage is advanced in the direction of the arrow in FIG. 8, with those cams which are shown hatched projecting to their position for camming action, the selector jacks move over the bottom surface (top surface as viewed in the drawing) of the lifting cam 131 and are aligned by the arranging cam 133, after which the selector jacks that have not been pushed by the selectors 134 are caused to ride on the lifting cams 131. The jacks 102 are then raised onto the lifting cams 119 and the knitting cams 120 to thereby pushing the knitting needles 101 upwardly to the knitting position. The jacks 102 are thereafter lowered a half amount by the half lowering cams 121 to bring their butts 110 into the position subject to the camming action by the tuck selection cams 118. The jacks 102 move over the tuck selection cams 118 held in the retracted position in the system G and ride on the tuck cams 116. In response to such motion, the needles are raised to the tucking position. The selector jacks which have ridden on the lifting cam 131 are immediately lowered by the cam 130, move over the central lifting cam 131, are aligned by the arranging cam 133, and then are selected again by the selectors. The selector jacks that have not been pushed by the selectors, are advanced by the lifting cam 131. The jacks 102 are thus advanced by the lifting cam 119 and the knitting cam 120, thereby raising the needles to the knitting position. Simultaneous knitting, tucking and non-knitting is thus aided by the needles held at rest by the selector jacks pushed by any selector in the system G. With this arrangement, concurrent knitting, tucking and non-knitting is possible in a next system during the first stroke without the preparatory step for a stroke as in the previous embodiment. The jacks riding on the knitting cams 120 in the next system G are lowered by the lowering cams 122. The jacks which are not pushed by the selectors in the system G and thus are raised by the selector jacks, remain in the position for the camming action by the tuck selection cams 118.

FIG. 9 illustrates a next stroke for reversal of the carriage, in which simultaneous knitting, tucking and non-knitting is performed by the jacks that remain in the position for the camming action by the tuck selection cams in the previous stroke, newly selected by the selectors in the system G, and hence by the jacks associated with the selector jacks that do not ride on the lifting cams 131, and by the jacks that ride on the knitting cams. If one of the half lowering cams 121 that is located ahead in the direction of travel of the carriage, project into the position for the camming action, the jacks selected and raised in the systems F and G, all ride on the tuck cams to bring the needles in the tucking position. Furthermore, with the tuck selection cams 118 projecting to the position for the camming action, all the raised jacks ride on the knitting cams to place the needles in the knitting position.

It is to be understood that although certain preferred embodiments have been shown and described in detail, various changes and modifications may be made therein without departing from the scope of the appended claims.

I claim:

1. In a flat bed knitting machine of the type comprising a pair of needle beds arranged cross-sectionally in an inverted V-shape, a plurality of needles disposed in needle slots in each of said needle beds, a jack disposed in each needle slot for controlling the movement of the needle, a selector jack for actuating the needle-actuating jack, a carriage movable on said needle bed and provided with a cam plate facing each needle bed, a selector controllablee electrically in accordance with a patternfor pushing the selector jacks and angularly moving the selector jacks in said needle slots to place their butts out of the camming action; the improvement wherein said cam plate has a group of cams for acting on butts of the jacks, said group of cams including a tuck cam for acting on jack butts so as to advance the needles associated with the jacks to a tucking position, and a unit of cams composed of fixed cams and movable cams arranged in an inverted V-shape around the tuck cam for acting on jack butts to thereby advance the needles to a knitting position; control means for controlling selected jacks to shift their butts to a tucking position in which they move over the movable cams retracted in their inoperative position, and engageable with the tuck cam; and raising means for advancing jacks associated with the selector jacks newly selected by the selectors after the selection of said jacks, to a position upward of said tucking position, for enabling the jacks to engage with the upper cams in said unit of cams.

2. A flat bed knitting machine according to claim 1 including an auxiliary jack disposed in the needle slot and actuatable by the selector jack for actuating the needle-actuating jack, said cam plate further having a group of cams for acting on the butt of the auxiliary jack.

3. A flat bed knitting machine according to claim 2 wherein said group of cams for acting on the butt of the auxiliary jack comprises a movable cam for advancing the jack to locate its butt in a position subject to the camming action by the tuck cam, and movable knitting cams for further raising the jack to locate its butt in a position subject to the camming action by the upper cam of the unit of cams.

4. A flat bed knitting machine according to claim 1 wherein said group of cams including movable half lowering cams arranged outside of the unit of cams for lowering the jack to said tucking position.

5. A flat bed knitting machine according to claim 1 wherein said group of cams includes fixed subsidiary cams arranged around the unit of cams in the form of an inverted V-shape for lowering the jack that has been raised by the tuck cam, and the jacks that has been raised by said unit of cams to advance the needle to the knitting position, down to said tucking position.

6. A flat bed knitting machine according to claim 5 including movable lowering cams disposed beneath said fixed subsidiary cams for lowering the jack to an initial position.

7. A flat bed knitting machine according to claim 1 wherein said cam plate has thereon a pair of substantially identical cam sets.

8. A flat bed knitting machine according to claim 1 wherein said selector jack has a bottom defined by a flat surface and a tapered surface and tiltable in the needle slot.

* * * * *